US005922525A

United States Patent [19]

Garnsey et al.

[11] Patent Number: 5,922,525

[45] **Date of Patent: *Jul. 13, 1999**

[54] PHOTOGRAPHIC MATERIAL HAVING A RED SENSITIZED SILVER HALIDE EMULSION LAYER WITH IMPROVED HEAT SENSITIVITY

[75] Inventors: Richard Paul Garnsey, Fairport; Pamela McCue Ferguson, Farmington; Richard Lee Parton, Webster; Paul Timothy Hahm, Hilton, all of N.Y.

[73] Assignee: Eastman Kodak Company, Rochester, N.Y.

[ * ] Notice: This patent is subject to a terminal disclaimer.

[21] Appl. No.: 08/629,419

[22] Filed: Apr. 8, 1996

[51] Int. Cl.[6] ..... G03C 1/09; G03C 1/08

[52] U.S. Cl. ..... 430/572; 430/574; 430/576; 430/584; 430/604; 430/605; 430/611; 430/613

[58] Field of Search ..... 430/574, 604, 430/584, 605, 476, 472, 611, 613, 572

[56] References Cited

U.S. PATENT DOCUMENTS

| | | | |
|---|---|---|---|
| 3,617,293 | 11/1971 | Shiba et al. . | |
| 4,442,201 | 4/1984 | Takada et al. | 430/569 |
| 4,820,624 | 4/1989 | Hasebe et al. | 430/567 |
| 4,920,042 | 4/1990 | Waki | 430/380 |
| 4,939,080 | 7/1990 | Hioki et al. | 430/576 |
| 4,945,035 | 7/1990 | Keevert, Jr. et al. . | |
| 5,112,731 | 5/1992 | Miyasaka | 430/567 |
| 5,126,237 | 6/1992 | Okumura et al. | 430/577 |
| 5,154,995 | 10/1992 | Kawai et al. | 430/22 |
| 5,175,080 | 12/1992 | Hioki et al. | 430/584 |
| 5,223,385 | 6/1993 | Hasebe | 430/546 |
| 5,246,828 | 9/1993 | Okuyama et al. | 430/576 |
| 5,260,183 | 11/1993 | Ishiguro et al. | 430/567 |
| 5,290,675 | 3/1994 | Hioki et al. | 430/576 |
| 5,292,635 | 3/1994 | Lok | 430/611 |
| 5,296,343 | 3/1994 | Hioki et al. | 430/508 |
| 5,338,657 | 8/1994 | Kato et al. | 430/584 |
| 5,518,876 | 5/1996 | Parton et al. | 430/584 |

FOREIGN PATENT DOCUMENTS

| | | |
|---|---|---|
| 0 271 260 | 6/1988 | European Pat. Off. . |
| 0 286 331 | 10/1988 | European Pat. Off. . |
| 0 336 426 | 10/1989 | European Pat. Off. . |
| 0 367 227 | 5/1990 | European Pat. Off. . |
| 0 476 604 A1 | 3/1992 | European Pat. Off. . |
| 0 563 860 | 10/1993 | European Pat. Off. . |
| 0 605 917 | 7/1994 | European Pat. Off. . |
| 4002016 | 8/1990 | Germany . |
| 60-225147 | 11/1985 | Japan . |
| 61-093448 | 5/1986 | Japan . |
| 62-131250 | 6/1987 | Japan . |
| 62-253141 | 11/1987 | Japan . |
| 63-259649 | 10/1988 | Japan . |
| 01124843 | 5/1989 | Japan . |
| 1124844 | 5/1989 | Japan . |
| 01189649 | 7/1989 | Japan . |
| 02140736 | 5/1990 | Japan . |
| 02212832 | 8/1990 | Japan . |
| 03080251 | 4/1991 | Japan . |
| 03181939 | 8/1991 | Japan . |
| 4-73740 | 3/1992 | Japan . |
| 04322244 | 11/1992 | Japan . |
| 2216279 | 10/1989 | United Kingdom . |

OTHER PUBLICATIONS

Berry, Chester R., *Changes of Silver Halide Energy Levels with Temperature and Halide Composition*, vol. 19, No. 2, (Mar./Apr. 1975), pp. 93–95.

Vanassche, W., The Effect of Chemical Sensitization and Halogen Composition of the Emulsion of Spectral Sensitization, The Journal of Photographic Science, vol. 21, (1973), pp. 180–186.

Gillman, P.B., Use of Spectral Sensitizing Dyes to Estimate Effective Energy Levels of Silver Halide, Photographic Science and Engineering, vol., 18 No. 5 (Sep./Oct. 1974), pp. 475–485.

*Primary Examiner*—Thorl Chea
*Attorney, Agent, or Firm*—Edith A. Rice

[57] ABSTRACT

A silver halide photographic material having improved heat sensitivity comprises a red sensitive silver halide emulsion layer the silver halide of which is prepared in the presence of a hexacoordination complex of rhenium, ruthenium or osmium with at least four cyanide ligands and comprising at least about 90 mole percent silver chloride, wherein the emulsion contains a thiosulfonate and a sulfinate or seleninate and at least one red sensitizing dye.

25 Claims, No Drawings

PHOTOGRAPHIC MATERIAL HAVING A RED SENSITIZED SILVER HALIDE EMULSION LAYER WITH IMPROVED HEAT SENSITIVITY

CROSS REFERENCE TO RELATED APPLICATION

Reference is made to and priority claimed from U.S. Provisional Application Ser. No. U.S. 60/004,514, filed Sep. 29, 1995, entitled PHOTOGRAPHIC MATERIAL HAVING A RED SENSITIZED SILVER HALIDE EMULSION LAYER WITH IMPROVED HEAT SENSITIVITY.

FIELD OF THE INVENTION

This invention relates to a photographic material having a red sensitized silver halide emulsion layer with improved heat sensitivity.

BACKGROUND OF THE INVENTION

There is a great emphasis on high productivity in the photosensitive materials market. Photofinishers that use photosensitive paper to produce color prints desire short processing times in order to increase output. One way to obtain rapid processing is to accelerate the development time by increasing the chloride content of the emulsions; the higher the chloride content the higher the development rate. However, it is also known that the higher the chloride content is, the harder it is to obtain high, invariant photosensitivity. Emulsions that are primarily silver chloride are more difficult to spectrally sensitize than emulsions used previously such as silver bromide or chlorobromide emulsions because the conduction band of silver chloride is higher than that of silver bromide (C. R. Berry, Photo. Sci. & Eng. 19, 93, (1975)).

The problem with sensitizing efficiency is especially true in the red-sensitive layer of many color print photosensitive materials and is related to the red sensitizers reduction potential. Correlations between dye reduction potentials and sensitizing efficiency on high silver chloride emulsions are discussed by W. Vanassche, J. Photo. Sci., 21, 180 (1973) and P. B. Gilman, Jr., Photo. Sci. & Eng. 18, 475 (1974). Another common problem with the red sensitive layer of color print paper which contains an emulsion that is primarily silver chloride, is an undesirable sensitivity to temperature. An increase in temperature of the paper during exposure results in an increase in red speed of the red sensitive layer making it difficult for the photofinisher to adjust his printing conditions. This results in a loss in operating efficiency.

An example of heat sensitivity is illustrated below. Material C has no propensity for heat sensitivity while Material A and B have equal propensity but in opposite directions. Color photographic materials typically respond to three regions of the spectrum, red, green and blue with different emulsions and, as an example for color positive paper such as EKTACOLOR Paper, will produce cyan, magenta and yellow dye images when processed in Process RA-4. If the paper temperature changes during the day as it is printed such as due to changing ambient conditions or warming up in the printing environment, the prints can change in density causing a variability in the image produced. With color products a mis-match in the heat sensitivity response of the three layers results in a color shift in the prints. So, while it would be useful to have low heat sensitivity to preserve color consistency in printing, it is more important with color products to have a consistent heat sensitivity shift in all three layers to avoid a shift in the more critical area of color balance. Almost all of the materials used to prepare silver halide emulsions can under some conditions affect the heat sensitivity of the resulting photographic materials. It is therefore desirable to have the ability to adjust the heat sensitivity of a particular emulsion to the appropriate level to match the other two layers.

| | Speed (Log E) of Materials at 22° C. | Speed (Log E) of Materials at 40° C. | Heat Sensitivity (Delta Log E) |
|---|---|---|---|
| Material A | 1.90 | 2.00 | +.10 |
| Material B | 2.00 | 1.90 | −.10 |
| Material C | 1.90 | 1.90 | 0.00 |

European published patent application EP 605,917 A2 describes red dyes that give high speed and reduced heat sensitivity when used on high chloride emulsions. However, by the use of these red sensitizers, the heat sensitivity of the cyan layer is so low that it no longer matches that of the magenta and yellow records. This causes an undesirable color balance shift during thermal changes. It is therefore desirable to provide a means of adjusting the heat sensitivity in the cyan layer so as to match that of the magenta and yellow layers. It is toward this end that this invention is directed.

PROBLEM TO BE SOLVED BY THE INVENTION

The prior art teaches the use of red dyes that give reduced heat sensitivity. But there is no teaching on how to use these dyes so that the heat sensitivity of the red layer matches that of the magenta and yellow records and thus to avoid heat induced changes in color balance. Summary of the Invention One aspect of this invention comprises a photographic material comprising a red sensitive silver halide emulsion layer, the silver halide of which comprises silver halide grains prepared in the presence of a hexacoordination complex of rhenium, ruthenium or osmium with at least four cyanide ligands and comprising at least about 90 mole percent silver chloride, wherein the emulsion contains a thiosulfonate compound, a sulfinate or seleninate compound and a dye of Class A or Class B:

where,

Class A dyes have structure I and substituents $W_1$–$W_8$ are chosen such that J is ≧0.0, where J is defined as the sum of the Hammett $\sigma_p$ values of $W_{1-8}$, or, alternatively, Class A dyes can also have the structure II provided substituents $W_1$–$W_8$ are chosen such that J is ≧0.24;

Class B dyes have structure II and substituents $W_1$–$W_8$ are chosen independently such that J is ≦0.10, or, alternatively, Class B dyes can also have structure I provided substituents $W_1$–$W_8$ are chosen such that J is ≦−0.14

(I)

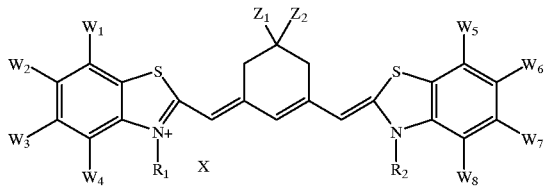

-continued (II)

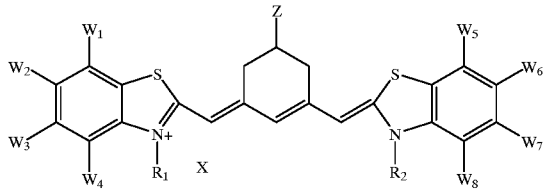

where, $R_1$ and $R_2$ each independently represent an alkyl group or a substituted alkyl group;

X is a counterion, if needed, to balance the charge of the dye;

Z is a hydrogen or halogen atom or an alkyl group or a substituted alkyl group;

$Z_1$ and $Z_2$ are each independently a 1–8 carbon alkyl group;

ADVANTAGEOUS EFFECT OF THE INVENTION

The present invention provides photographic materials with a high silver chloride layer having high red sensitivity while at the same time having relatively low thermal sensitivity. A method is described to adjust the heat sensitivity of the cyan layer so as to match that of the magenta and yellow layers to maintain color balance despite thermal fluctuations.

DETAILED DESCRIPTION OF EMBODIMENTS OF THE INVENTION

The silver halide emulsion can be prepared as described in U.S. Pat. No. 4,945,035 of Keevert et al., the disclosure of which is incorporated herein by reference. The silver halide emulsion is a "high chloride" emulsion containing at least about 90 mole percent chloride, preferably at least about 95 mole percent chloride and optimally at least about 98 mole percent chloride. Some silver bromide may be present; in particular, the possibility is also contemplated that the silver chloride could be treated with a bromide source to increase its sensitivity, although the bulk concentration of bromide in the resulting emulsion will typically be no more than about 2 to 2.5 mole percent and preferably between about 0.6 to 1.2 mole percent (the remainder being silver chloride). The emulsion should contain less than 5 mole percent iodide, preferably less than 2 mole percent iodide.

The preferred hexacoordinated rhenium, ruthenium, and osmium cyanide complexes can be represented by the following formula:

$$[Q(CN)_{6-y}L_y]^{-n}$$

where:

Q is rhenium, ruthenium, or osmium,

L is a bridging ligand, y is 0, 1, or 2, and

−n is −2, −3, or −4.

The bridging ligand is preferably a monoatomic monodentate ligand, such as a halide, for example, fluoride, chloride, bromide or iodide ligands, or a multielement ligand, for example, azide or thiocyanate ligands. In a particularly preferred embodiment, Q is ruthenium and y is 0.

The hexacoordinated complexes in most instances exhibit a net ionic charge. One or more counter ions are therefore usually associated with the complex to form a charge neutral compound. The counter ion is of little importance, since the complex and its counter ion or ions dissociate upon introduction into an aqueous medium, such as that employed for silver halide grain formation. Ammonium and alkali metal counter ions are particularly suitable for anionic hexacoordinated complexes, since theses cations are known to be fully compatible with silver halide precipitation procedures.

Table I provides a listing of illustrative rhenium, ruthenium, and osmium cyanide coordination complexes.

TABLE I

| | |
|---|---|
| $[Re(CN)_6]^{-4}$ | $[OsF_2(CN)_4]^{-4}$ |
| $[Ru(CN)_6]^{-4}$ | $[ReCl_2(CN)_4]^{-4}$ |
| $[Os(CN)_6]^{-4}$ | $[RuCl_2(CN)_4]^{-4}$ |
| $[ReF(CN)_5]^{-4}$ | $[OsCl_2(CN)_4]^{-4}$ |
| $[RuF(CN)_5]^{-4}$ | $[ReBr_2(CN)_4]^{-4}$ |
| $[OsF(CN)_5]^{-4}$ | $[RuBr_2(CN)_4]^{-4}$ |
| $[ReCl(CN)_5]^{-4}$ | $[OsBr_2(CN)_4]^{-4}$ |
| $[RuCl(CN)_5]^{-4}$ | $[RuI_2(CN)_4]^{-4}$ |
| $[OsCl(CN)_5]^{-4}$ | $[OsI_2(CN)_4]^{-4}$ |
| $[ReBr(CN)_5]^{-4}$ | $[Ru(CN)_5(OCN)]^{-4}$ |
| $[RuBr(CN)_5]^{-4}$ | $[Os(CN)_5(OCN)]^{-4}$ |
| $[OsBr(CN)_5]^{-4}$ | $[Ru(CN)_5(SCN)]^{-4}$ |
| $[ReI(CN)_5]^{-4}$ | $[Os(CN)_5(SCN)]^{-4}$ |
| $[RuI(CN)_5]^{-4}$ | $[Ru(CN)_5(N_3)]^{-4}$ |
| $[OsI(CN)_5]^{-4}$ | $[Os(CN)_5(N_3)]^{-4}$ |
| $[ReF_2(CN)_4]^{-4}$ | $[Ru(CN)_5(H_2O)]^{-3}$ |
| $[RuF_2(CN)_4]^{-4}$ | $[Os(CN)_5(H_2O)]^{-3}$ |

The hexacoordination complex is preferably utilized in an amount of $1\times10^{-6}$ mole of complex per mole of silver in the emulsion. The complex can be incorporated into the grains up to its solubility limit, typically about $5\times10^{-4}$ mole per silver mole. An excess of the complex over its solubility limit in the grain can be tolerated, but normally any such excess is removed from the emulsion during washing. Preferred concentrations of the complex are from $10^{-5}$ to $10^{-4}$ mole per silver mole.

The emulsion also contains a thiosulfonate compound and a sulfinate or seleninate compound. The thiosulfonate compound is preferable a compound of formula (IV):

$$T^1—SO_2S—Y^1 \quad (IV)$$

and the sulfinate compound is preferable a compound of formula (Va):

$$T^2—SO_2—Y^2 \quad (Va)$$

and the seleninate compound is preferably a compound of formula (IVb)

$$T^2—SeO_2—Y^2 \quad (Vb)$$

$Y^1$ and $Y^2$ are independently selected from the group consisting of a metal ion and

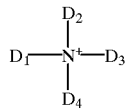

wherein $D_1$, $D_2$, $D_3$, and $D_4$ are independently selected from the group consisting of hydrogen and an alkyl of 1–3 carbon atoms, and $T^1$ and $T^2$ are independently selected from the group consisting of an unsubstituted or substituted alkyl of 1 to 22 carbon atoms, an alkenyl of 2 to 22 carbon atoms, an alkynyl of 2 to 22 carbon atoms, an unsubstituted or substituted aryl group having 6 to 20 carbon atoms, an unsubstituted or substituted 5 to 15-membered heterocyclic group having one or two heteroatoms and a divalent linking group. Examples of suitable aryl groups are phenyl, tolyl, naphthyl, cycloheptatrienyl, cyclooctatrienyl, and cyclononatrienyl. Examples of suitable heterocyclic groups are pyrrolyl, furanyl, tetrahydrofuranyl, thiofuranyl, pyridino, picolino, piperidino, morpholino, pyrrolidino, thiophene, oxazole, thiazole, imidazole, selenazole, tellurazole, triazole, tetrazole and oxadiazole. Examples of suitable divalent linking groups are —$(CH(CH_2)_m$— where m is 1 to 11, —(CH—CH═CH—$CH_2$)— and —$(C(CH_3)CH_2)$—. When $T^1$ or $T^2$ is a divalent linking group, the compound of formula (IV), (Va) or (Vb), respectively, is polymeric, with the repeating unit being of formula (IV), (Va), or (Vb), respectively.

In a preferred embodiment $Y^1$ and $Y^2$ are independently selected from $Na^+$, $K^+$ and

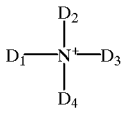

and $T^1$ and $T^2$ are independently selected from an unsubstituted phenyl group or a phenyl group substituted in one or two positions independently selected from the group consisting of an alkyl having 1 to 10 carbon atoms, an alkoxy having 1 to 10 carbon atoms, an acyl having 1 to 10 carbon atoms, an hydroxyl, a phenyl, a tolyl, a naphthyl, a carboxy, a chloro, a bromo, a nitro, a cyano, an acetamido, a carbamoyl, an ureido, an unsubstituted amino, and an amino substituted with one or two alkyls being the same or different and each having 1 to 3 carbon atoms. In a more preferred embodiment, $Y^1$ and $Y^2$ are each $Na^+$ or $K^+$ and $T^1$ and $T^2$ are each a tolyl group. Most preferred are the $Na^+$ or $K^+$ salts of p-toluene thiosulfonate and p-toluene sulfinate.

As mentioned above, the emulsion comprises a dye of Class A of structural formula (I) or a dye of Class B of structural formula (II). In these formulae, $W_1$–$W_8$ each independently represent an alkyl, acyl, acyloxy, alkoxycarbonyl, carbonyl, carbamoyl, sulfamoyl, carboxyl, cyano, hydroxy, amino, acylamino, alkoxy, alkylthio, alkylsulfonyl, sulfonic acid, aryl, or aryloxy group, any of which may be substituted or unsubstituted, or a hydrogen or halogen atom, and provided further that adjacent ones of $W_1$–$W_8$ can bonded to each other via their carbon atoms to form a condensed ring. Class A dyes have structure I and substituents $W_1$–$W_8$ are chosen such that J is $\geqq 0.0$, or, alternatively, Class A dyes can also have the structure II provided substituents $W_1$–$W_8$ are chosen such that J is $\geqq 0.24$ and Class B dyes have structure II and substituents $W_1$–$W_8$ are chosen such that J is $\leqq 0.10$, or, alternatively, Class B dyes can also have structure I provided substituents $W_1$–$W_8$ are chosen such that J is $\leqq -0.14$. Hammett $\sigma_p$ values are discussed in *Advanced Organic Chemistry* 3rd Ed., J. March, (John Wiley Sons, NY; 1985). Note that the "p" subscript refers to the fact that the σ values are measured with the substituents in the para position.

Z is a hydrogen or halogen atom or an alkyl group or substituted alkyl group, for example a 1 to 8 carbon atom alkyl group or substituted alkyl group. Preferably Z is a relatively "flat" substituent, such as a hydrogen, halogen or a methyl (substituted or unsubstituted). More particularly Z may be a substituted or unsubstituted methyl or a hydrogen.

$Z_1$ and $Z_2$ are independently a 1 to 8 carbon alkyl group (for example, methyl, ethyl, propyl, butyl or the like).

Preferably at least one of $R_1$ or $R_2$, or both, are alkyl of 1–8 carbon atoms, either of which alkyl may be substituted or unsubstituted. Examples of preferred substituents include acid or acid salt groups (for example, sulfo or carboxy groups). Thus, either or both $R_1$ or $R_2$ could be, for example, 2-sulfobutyl, 3-sulfopropyl and the like, or sulfoethyl.

In preferred embodiments of the invention, the emulsion contains a dye of Class A and a dye of Class B.

Examples of Class A and B dyes used in materials of the present invention are listed below in Table II but the present invention is not limited to the use of these dyes.

TABLE II

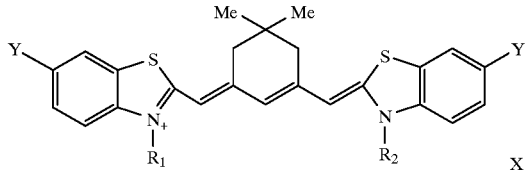

| Dye | Y | $R_1$ | $R_2$ | X |
|---|---|---|---|---|
| A-1 | H | 3Sp | Et | — |
| A-2 | H | Et | Et | $pts^-$ |
| B-3 | Me | Et | Et | $pts^-$ |
| B-7 | Me | Et | $nC_5H_{12}$ | $I^-$ |

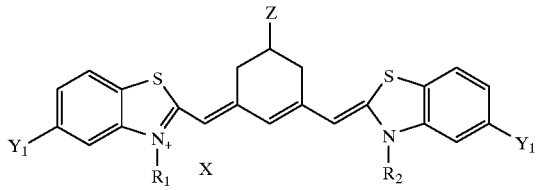

| Dye | Z | Y1 | R1 | R2 | X |
|---|---|---|---|---|---|
| A-3 | H | C1 | Et | Et | $pts^-$ |
| B-1 | H | H | Et | Et | $pts^-$ |
| B-2 | H | Ph | Et | Et | $pts^-$ |
| B-4 | Me | H | Et | Et | $BF_4^-$ |
| B-5 | H | Me | Et | Et | $pts^-$ |
| B-6 | H | Ph | —$CH_2CH_2OH$ | —$CH_2CH_2OH$ | $pts^-$ |

3Sp is 3-sulfopropyl, $pts^-$ is p-toluenesulfonate

One embodiment of the invention comprises a photographic element containing a dye of formula (Ia) used in combination with a dye for formula (IIa):

(Ia)

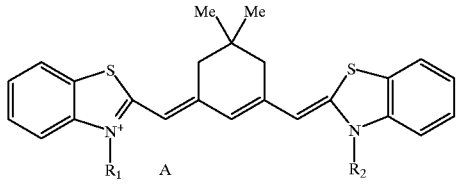

(IIa)

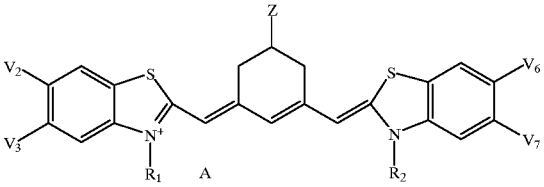

in which:

$R_1$ and $R_2$ each independently represent an alkyl group or a substituted alkyl group;

$V_2$–$V_7$ are independently H or a 1 to 8 carbon alkyl;

Z is a hydrogen or methyl;

A is a counterion if needed to balance the charge.

The emulsion preferably also contains an anti-aggregating agent. Preferably the anti-aggregating agent is compound III which has the structure:

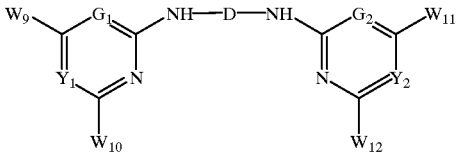

(III)

wherein:

D is a divalent aromatic moiety; $W_9$–$W_{12}$ each independently represents a hydroxy, a halogen atom, an amino, alkylamino, arylamino, cycloalkylamino, a heterocyclic, heterocyclicamino, arylalkylamino, alkoxy, aryloxy, alkylthio, heterocyclicthio, mercapto, alkylthio, arylthio or aryl group, any of which may be substituted or unsubstituted, or a hydrogen or halogen atom;

$G_1$ and $G_2$ each represents N or CH;

$Y_1$ and $Y_2$ each represents N or CH provided at least one of $G_1$ and $Y_1$ is N and at least one of $G_2$ and $Y_2$ is N.

In compound III, D is a divalent aromatic moiety, preferably selected from the group consisting of:

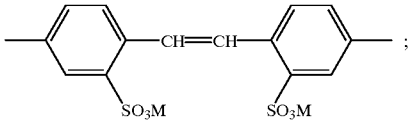

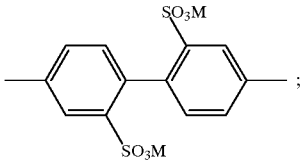

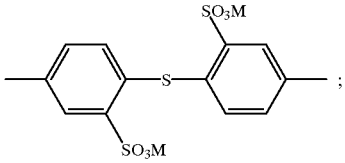

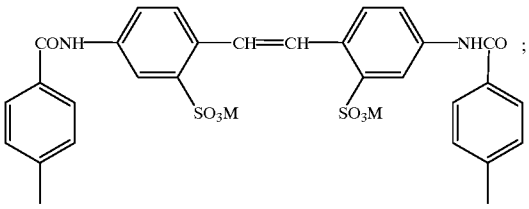

-continued

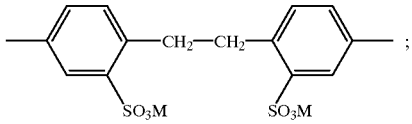

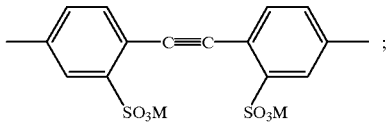

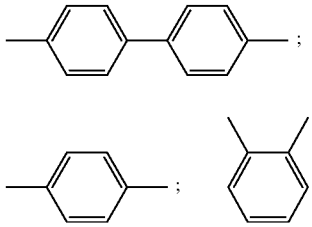

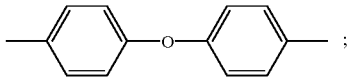

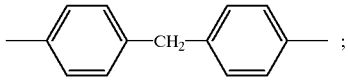

and

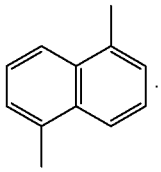

In the above, M is a hydrogen atom or a cation so as to increase water solubility, such as an alkali metal ion (Na, K, and the like) or an ammonium ion.

Some particular examples of compounds of Formula III above are listed below. Again, the invention is not limited to the use of those specific compounds:

III-1

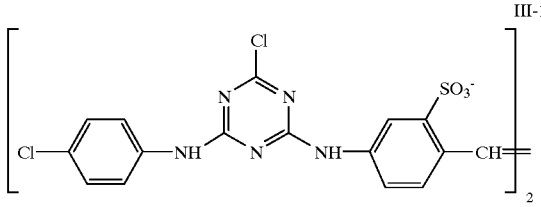

III-2

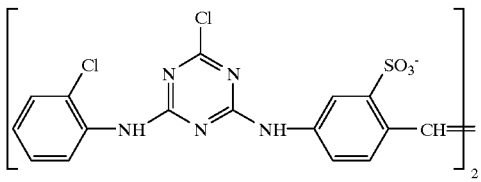

-continued

III-3

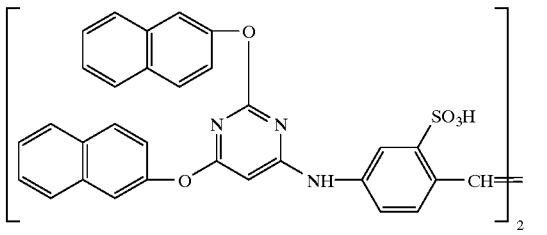

Dyes of Class A and B and compounds of formula III can be prepared according to techniques that are well-known in the art, such as described in Hamer, *Cyanine Dyes and Related Compounds,* 1964 (publisher John Wiley & Sons, New York, NY) and James, *The Theory of the Photographic Process* 4th edition, 1977 (Eastman Kodak Company, Rochester, N.Y.). The amount of sensitizing dye that is useful in the invention may be from 0.001 to 4 millimoles, but is preferably in the range of 0.01 to 4.0 millimoles per mole of silver halide and more preferably from 0.02 to 0.25 millimoles per mole of silver halide. Optimum dye concentrations can be determined by methods known in the art. Formula III compounds can be typically coated at 1/50 to 50 times the dye concentration, or more preferably 1 to 10 times.

The photographic materials of the present invention can contain tabular grain emulsions such as disclosed by Wey U.S. Pat. No. 4,399,215; Kofron U.S. Pat. No. 4,434,226; Maskasky U.S. Pat. No. 4,400,463; and Maskasky U.S. Pat. No. 4,713,323; as well as disclosed in allowed U.S. applications: Ser. Nos. 819,712 (filed Jan. 13, 1992), 820,168 (filed Jan. 13, 1992), 762,971 (filed Sep. 20, 1991), 763,013 (filed Jan. 13, 1992), and pending U.S. application Ser. No. 763,030 (filed Sep. 20, 1992). The grain size of the silver halide may have any distribution known to be useful in photographic compositions, and may be ether polydispersed or monodispersed.

The silver halide grains to be used in the invention may be prepared according to methods known in the art, such as those described in *Research Disclosure*, (Kenneth Mason Publications Ltd, Emsworth, England), September, 1994, Number 365, Item 36544 (hereinafter referred to as *Research Disclosure I*) and James, *The Theory of the Photographic Process*. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation. High chloride [1 0 0] tabular emulsions such as described in EP 534,395 can also be used.

The silver halide to be used in the invention may be advantageously subjected to chemical sensitization with compounds such as gold sensitizers (e.g., gold and sulfur) and others known in the art. Compounds and techniques useful for chemical sensitization of silver halide are known in the art and described in *Research Disclosure I* and the references cited therein.

The photographic materials of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as illustrated in *Research Disclosure*, June 1975, item 13452 and U.S. Pat. No. 3,772,031.

The silver halide may be sensitized by a dye of Class A and/or a dye of Class B and, optionally, a compound of Formula III by methods known in the art, such as described in *Research Disclosure I*. The compounds may be added to an emulsion of the silver halide grains and a hydrophilic colloid at any time prior to (e.g., during or after chemical sensitization) or simultaneous with the coating of the emulsion on a photographic element. The resulting sensitized silver halide emulsion may be mixed with a dispersion of color image-forming coupler immediately before coating or in advance of coating (for example, 2 hours). Essentially any type of emulsion (e.g., negative-working emulsions such as surface-sensitive emulsions of unfogged internal latent image-forming emulsions, direct-positive emulsions such as surface fogged emulsions, or others described in, for example, *Research Disclosure I*) may be used. The above-described sensitizing dyes of Class A and Class B can be used alone, or may be used in combination with other sensitizing dyes, e.g. to also provide the silver halide with sensitivity to wavelengths of light outside the red region or to supersensitize the silver halide.

Other addenda in the emulsion may include antifoggants, stabilizers, filter dyes, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure I* and the references cited therein. The emulsion may also include brighteners, such as stilbene brighteners.

The emulsion layer containing silver halide sensitized with as described above, can be coated simultaneously or sequentially with other emulsion layers, subbing layers, filter dye layers, interlayers, or overcoat layers, all of which may contain various addenda known to be included in photographic elements. These include antifoggants, oxidized developer scavengers, DIR couplers, antistatic agents, optical brighteners, light-absorbing or light-scattering pigments, and the like. The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

Photographic materials of the present invention can be black and white photographic elements but are preferably color photographic elements. A color photographic element generally contains three silver emulsion layers or sets of layers (each set of layers often consisting of emulsions of the same spectral sensitivity but different speed): a blue-sensitive layer having a yellow dye-forming color coupler associated therewith; a green-sensitive layer having a magenta dye-forming color coupler associated therewith; and a red-sensitive layer having a cyan dye-forming color coupler associated therewith. Those dye forming couplers are provided in the emulsion typically by first dissolving or dispersing them in a water immiscible, high boiling point organic solvent, the resulting mixture then being dispersed in the emulsion. Suitable solvents include those in European Patent Application 87119271.2. Dye-forming couplers are well-known in the art and are disclosed, for example, in *Research Disclosure I.*

Photographic elements of the present invention may also usefully include a magnetic recording layer as described in *Research Disclosure*, Item 34390, November 1992.

Photographic elements comprising the composition of the invention can be processed in any of a number of well-known photographic processes utilizing any of a number of well-known processing compositions, described, for example, in *Research Disclosure I*, or in James, *The Theory of the Photographic Process* 4th, 1977.

Photographic Evaluation Example

A high chloride halide emulsion was precipitated by equimolar addition of silver nitrate and sodium chloride solutions into a well-stirred reactor containing gelatin peptizer and thioether ripener. The resultant emulsion contains cubic shaped grains of 0.38 $\mu$m in edgelength size. Emulsions are compared in the presence and absence of ruthenium hexacyanide complex ($K_4Ru(CN)_6$) a dopant at a level of 75 mppm. Portions of this emulsion were sensitized in the following manner. The emulsion at 40° C. was adjusted to a pH of 4.3 with nitric acid and a vAg of 129 with KCl followed by gold and sulfur sensitization. The temperature was increased to 65° C. and an antifoggant was added (1-(3-acetamidophenyl)-5-mercaptotetrazole, $0.95\times10^{-3}$ mol/molAg) and then combined with compound III-2 ($22.3\times10^{-5}$ mol/molAg) and then a soluble Bromide was added at 1.1 mole %, the temperature was then decreased to 40° C. and the pH of the emulsion was adjusted to 5.6 using NaOH solution. The dyes in Table III were added at $3.64\times10^{-5}$ mole/silver mole, various levels were used. In Table IV, the dyes were combined in various ratios to yield a total dye coverage of $3.64\times10^{-5}$ mole/silver mole.

The cyan coupler dispersion contained a cyan image forming coupler ((2-(alpha-(2,4-di-tert-amylphoxy)-butyramido-4,6-dichloro-5-ethyl phenyl)) (0.43 g/m$^2$, 39.3 mg/ft$^2$) and gelatin (0.85 g/m$^2$, 77.0 g/ft$^2$). The coupler dispersion was added to the dye/silver chloride emulsion immediately before coating. The elements also included a gelatin overcoat (1.08 g/m$^2$) and a gelatin undercoat layer (3.23 g/m$^2$). The layers were hardened with bis (vinylsulfonyl)methyl ether at 1.7% of the total gelatin weight. Materials were coated on a resin coated paper support.

To the cyan dispersion was added 1500 mg/m of p-toluene thiosulfonate (TSS) and 150mg/m of p-toluene sulfinate (TS).

To evaluate photographic sensitivity, the elements were exposed to a light source designed to simulate a color negative print exposure. The elements were then processed with RA-4 chemistry through a Colenta processor. This consists of color development (45 sec, 35° C.), bleach-fix (45 sec, 35° C.), and stabilization or water wash (90 sec, 35° C.) followed by drying 60 sec, 60° C.).

| | | |
|---|---|---|
| Color Developer | | |
| Lithium salt of sulfonated polystyrene | 0.25 | mL |
| Triethanolamine | 11.0 | mL |
| N,N-diethylhydroxylamine (85% by wt.) | 6.0 | mL |
| Potassium sulfite (45% by wt.) | 0.5 | mL |
| Color developing agent(4-(N-ethyl-N-2-methanesulfonylaminoethyl)-2-methyl-phenylenediaminesesquisulfatemonohydrate | 5.0 | g |
| Stilbene compound stain reducing agent | 2.3 | g |
| Lithium sulfate | 2.7 | g |
| Potassium chloride | 2.3 | g |
| Potassium bromide | 0.025 | g |
| Sequestering agent | 0.8 | mL |
| Potassium carbonate | 25.0 | g |
| Water to total of 1 liter, pH adjusted to 10.12 | | |
| Bleach-fix | | |
| Ammonium sulfite | 58 | g |
| Sodium thiosulfate | 8.7 | g |
| Ethylenediaminetetracetic acid ferric ammonium salt | 40 | g |
| Acetic acid | 9.0 | mL |
| Water to total 1 liter, pH adjusted to 6.2 | | |
| Stabilizer | | |
| Sodium citrate | 1 | g |
| Water to total 1 liter, pH adjusted to 7.2 | | |

LIRF is defined as low intensity reciprocity failure measured by calculating the difference between 0.2 sec and 100 sec exposure. A CR unit is defined as 0.01 logE.

Heat sensitivity was measured by comparing coatings exposed at room temperature (22° C.) with coatings exposed on a platen that was heated to 40° C. (coatings are equilibrated on the platen for 1.5' before exposing). The difference in speed is taken as a measurement of heat sensitivity. (The magnitude of the heat sensitivity also has an exposure time dependence. Measurements reported here were an 1/10" exposure at 1.0 density point of the D log E curve.)

Emulsions are compared in the presence and absence of ruthenium hexacyanide complex ($K_4Ru(CN)_6$) dopant at various levels including 50, 60, 75 mppm at various locations within the grain including bands of 75/80%, 75/90%, 80/92%. Both single dyes (Table III) and dye combinations (Table IV) would be preferably used with a tiazinylstilbene compound such as Compound III-2.

TABLE III

| Ru Complex | Compound III-2 | Dye | Heat Sensitivity | Heat Sensitivity TSS/TS |
|---|---|---|---|---|
| No | Yes | A-1 | 6.7 | −1.5 |
| No | No | A-1 | 10.6 | 1.3 |
| Yes | Yes | A-1 | 1.8 | −2.8 |
| Yes | No | A-1 | 1.7 | −4.3 |
| No | Yes | B-7 | 4.2 | −2.1 |
| No | No | B-7 | 5.5 | −2.3 |
| Yes | Yes | B-7 | −1.9 | −5.4 |
| Yes | No | B-7 | 1.1 | −6.2 |
| No | Yes | B-1 | 0.5 | −6.3 |
| No | No | B-1 | 3.9 | −3.7 |

TABLE III-continued

| Ru Complex | Compound III-2 | Dye | Heat Sensitivity | Heat Sensitivity TSS/TS |
|---|---|---|---|---|
| Yes | Yes | B-1 | −2.5 | −7.3 |
| Yes | No | B-1 | −2.7 | −7 |
| No | Yes | B-5 | −0.6 | −7.3 |
| No | No | B-5 | 2.5 | −0.9 |
| Yes | Yes | B-5 | −5.6 | −9.9 |
| Yes | No | B-5 | −2.2 | −5.9 |
| No | Yes | B-4 | 1.7 | −6 |
| No | No | B-4 | 5.6 | −0.5 |
| Yes | Yes | B-4 | −2.5 | −6.1 |
| Yes | No | B-4 | −0.1 | −4.5 |
| No | Yes | B-2 | 3.5 | −2.8 |
| No | No | B-2 | 6.7 | 2.9 |
| Yes | Yes | B-2 | −1 | −3.9 |
| Yes | No | B-2 | 2.3 | −2.3 |
| No | Yes | B-6 | 5.2 | −2.6 |
| No | No | B-6 | 11.3 | 3.9 |
| Yes | Yes | B-6 | −0.5 | −3.9 |
| Yes | No | B-6 | 5.3 | 0 |

Dye A is of structure I or II (I)

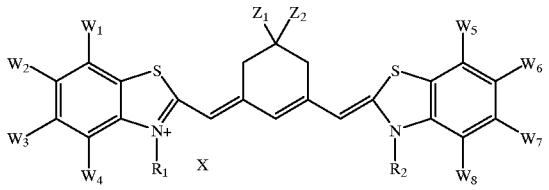

(II)

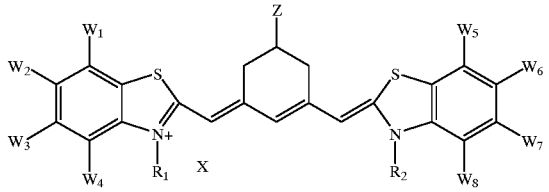

TABLE IV

| SAMPLE NO. | Dopant Location | Ru Complex | DYE A-1 PERCENT | DYE B-2 PERCENT | TSS/TS | LIRF 1/10–100" | HEAT SENSITIVITY .032" | HEAT SENSITIVITY .3" | HEAT SENSITIVITY 0.1" |
|---|---|---|---|---|---|---|---|---|---|
| 1 | | None | 100 | 0 | yes | −11 | 6.9 | 3.2 | 4.5 |
| 2 | | None | 75 | 25 | yes | −25 | 5.3 | 1 | −1.6 |
| 3 | | None | 50 | 50 | yes | −33 | 3 | −1.1 | −2.9 |
| 4 | | None | 25 | 75 | yes | −37 | 1.6 | −2.3 | −7.3 |
| 5 | | None | 0 | 100 | yes | −37 | 1.2 | −3.7 | −5.7 |
| 6 | 75/80% | 50 mppm | 100 | 0 | yes | −7 | 4.9 | −1.7 | 0.6 |
| 7 | " | 50 mppm | 75 | 25 | yes | −16 | 3.7 | −2 | −0.2 |
| 8 | " | 50 mppm | 50 | 50 | yes | −23 | 2.2 | −1.4 | −3.6 |
| 9 | " | 50 mppm | 25 | 75 | yes | −30 | 1.1 | −6 | −6.2 |
| 10 | " | 50 mppm | 0 | 100 | yes | −32 | 0.2 | −4.6 | na |
| 11 | 75/80% | 75 mppm | 100 | 0 | yes | −10 | 5.1 | 2 | 1 |
| 12 | " | 75 mppm | 75 | 25 | yes | −21 | 3.2 | −6.2 | −2.3 |
| 13 | " | 75 mppm | 50 | 50 | yes | −31 | 1.8 | −6 | −5.8 |
| 14 | " | 75 mppm | 25 | 75 | yes | −39 | −0.2 | −6.8 | −8 |
| 15 | " | 75 mppm | 0 | 100 | yes | −44 | −2.2 | −6.9 | −10.1 |
| 16 | 75/90% | 75 mppm | 100 | 0 | yes | −10 | 4.4 | 2.6 | −0.2 |
| 17 | " | 75 mppm | 75 | 25 | yes | −18 | 3.1 | −0.9 | −1.2 |
| 18 | " | 75 mppm | 50 | 50 | yes | −24 | 2.2 | −0.2 | −3.3 |
| 19 | " | 75 mppm | 25 | 75 | yes | −28 | 0.8 | −4 | −3.9 |
| 20 | " | 75 mppm | 0 | 100 | yes | −30 | 0.1 | −3.2 | −4.8 |
| 21 | 80/92% | 60 mppm | 100 | 0 | yes | −11 | 4.7 | 1.2 | 3.9 |
| 22 | " | 60 mppm | 75 | 25 | yes | −26 | 2.5 | −0.7 | −0.8 |
| 23 | " | 60 mppm | 50 | 50 | yes | −35 | 0.9 | −3.2 | −5.3 |
| 24 | " | 60 mppm | 25 | 75 | yes | −44 | −1.6 | −5.4 | −9.4 |
| 25 | " | 60 mppm | 0 | 100 | yes | −40 | −1.9 | −6 | −8 |

The invention has been described in detail with particular reference to preferred embodiments, but it will be understood that variations and modifications can be effected within the spirit and scope.

What is claimed is:

1. A silver halide photographic material comprising a red sensitive silver halide emulsion layer the silver halide of which is prepared in the presence of a hexacoordination complex of rhenium, ruthenium or osmium with at least four cyanide ligands and comprising at least about 90 mole percent silver chloride, wherein the emulsion contains a thiosulfonate and either a sulfinate or seleninate and a Dye A and Dye B:

wherein:

where, $R_1$ and $R_2$ each independently represent an alkyl group or a substituted alkyl group;

X is a counterion, if needed, to balance the charge of the dye;

Z is a hydrogen or halogen atom or an alkyl group or a substituted alkyl group;

$Z_1$ and $Z_2$ are each independently a 1–8 carbon alkyl group;

$W_1$–$W_8$ each independently represent a hydrogen atom, a halogen atom, an alkyl group, an acyl group, an acyloxy group, an alkoxycarbonyl group, a carbonyl group, a sulfamoyl group, carboxyl group, cyano group, hydroxy group, an amino group, an acylamino group, an alkoxy group, an alkylthio group, an alkylsulfonyl group, sulfonic acid group, aryl group, or aryloxy group, and $W_1$ and $W_2$; $W_2$ and $W_3$; $W_3$ and $W_4$; $W_5$ and $W_6$; $W_6$ and $W_7$; $W_7$ and $W_8$ can bond to each other via their carbon atoms to form a ring; and wherein:

in structure I substituents $W_1$–$W_8$ are chosen such that J is $\geqq 0.0$, where J is defined as the sum of the Hammett $\sigma_p$ values of $W_1$–$W_8$, and in structure II substitutents $W_1$–$W_8$ are chosen such that J is $\geqq 0.24$; and Dye B is of formula I or II:

(I)

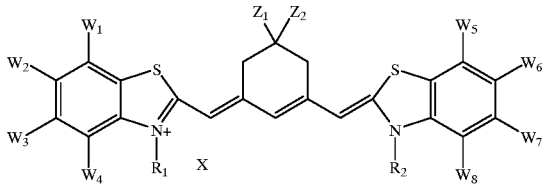

(II)

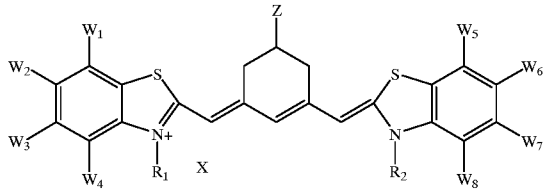

where, $R_1$ and $R_2$ each independently represent an alkyl group or a substituted alkyl group;

X is a counterion, if needed, to balance the charge of the dye;

Z is a hydrogen or halogen atom or an alkyl group or a substituted alkyl group;

$Z_1$ and $Z_2$ are each independently a 1–8 carbon alkyl group;

$W_1$–$W_8$ each independently represent a hydrogen atom, a halogen atom, an alkyl group, an acyl group, an acyloxy group, an alkoxycarbonyl group, a carbonyl group, a sulfamoyl group, carboxyl group, cyano group, hydroxy group, an amino group, an acylamino group, an alkoxy group, an alkylthio group, an alkylsulfonyl group, sulfonic acid group, aryl group, or aryloxy group, and $W_1$ and $W_2$; $W_2$ and $W_3$; $W_3$ and $W_4$; $W_5$ and $W_6$; $W_6$ and $W_7$; $W_7$ and $W_8$ can bond to each other via their carbon atoms to form a ring; and wherein:

in structure I substituents $W_1$–$W_8$ are chosen such that J is $\leqq -0.14$ and in structure II substituents $W_1$–$W_8$ are chosen such that J is $\leqq 0.10$.

2. A photographic material according to claim 1, wherein the hexacoordination complex is of the formula:

$$[Q(CN)_{6-y}L_y]^{-n}$$

where:

Q is rhenium, ruthenium, or osmium,

L is a bridging ligand, y is 0, 1, or 2, and

−n is −2, −3, or −4.

3. A photographic material according to claim 2, wherein Q is ruthenium and y is 0.

4. A photographic material according to claim 1, wherein the emulsion contains a thiosulfonate of formula (IV)

$$T^1—SO_2S—Y^1 \quad (IV)$$

and either a sulfinate compound of formula (Va):

$$T^2—SO_2—Y^2 \quad (Va)$$

or a seleninate compound of formula (Vb):

$$T^2—SeO_2—Y^2 \quad (Vb)$$

$Y^1$ and $Y^2$ are independently selected from the group consisting of a metal ion and

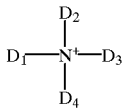

wherein $D_1$, $D_2$, $D_3$, and $D_4$ are independently selected from the group consisting of hydrogen and an alkyl of 1–3 carbon atoms, and $T^1$ and $T^2$ are independently selected from the group consisting of an unsubstituted or substituted alkyl of 1 to 22 carbon atoms, an alkenyl of 2 to 22 carbon atoms, an alkynyl of 2 to 22 carbon atoms, an unsubstituted or substituted aryl group having 6 to 20 carbon atoms, an unsubstituted or substituted 5 to 15-membered heterocyclic group having one or two heteroatoms and a divalent linking group.

5. A silver halide photographic material of claim 4, wherein the emulsion contains a thiosulfonate and a sulfinate.

6. A silver halide photographic material of claim 5, wherein the emulsion contains p-toluene thiosulfonate and p-toluene sulfinate.

7. A silver halide photographic material according to claim 1 wherein Z is hydrogen or a 1 to 8 carbon atom substituted or unsubstituted alkyl, and W1–W8 each independently represents a 1 to 8 carbon atom alkyl group, or a phenyl group, any of which is substituted or unsubstituted, or hydrogen.

8. A silver halide photographic material according to claim 1 wherein each of $W_1$–$W_8$ represents a methyl, hydrogen or phenyl.

9. A silver halide photographic material according to claim 1, wherein $W_1$–$W_8$ can independently represent hydrogen or methyl.

10. A silver halide photographic material according to claim 1, wherein both of $R_1$ and $R_2$ are alkyl of 1–8 carbon atoms.

11. A silver halide photographic material according to claim 1, wherein Z represents a hydrogen or a methyl group.

12. A silver halide photographic material according to claim 1, wherein $Z_1$ and $Z_2$ are methyl groups.

13. A silver halide photographic material according to claim 1, wherein Z represents a hydrogen.

14. A photographic material according to claim 1 wherein the silver halide emulsion further comprises a compound of formula (III):

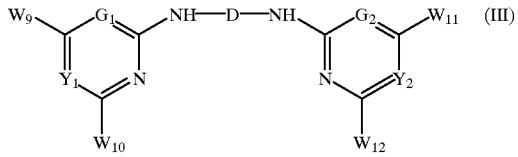

(III)

wherein:

D is a divalent aromatic moiety;

$W_9$–$W_{12}$ each independently represents a hydroxy, a halogen atom, an amino, alkylamino, arylamino, cycloalkylamino, a heterocyclic, heterocyclicamino, arylalkylamino, alkoxy, aryloxy, alkylthio, heterocyclicthio, mercapto, alkylthio, arylthio or aryl group, any of which may be substituted or unsubstituted, or a hydrogen or halogen atom;

$G_1$ and $G_2$ each represents N or CH;

$Y_1$ and $Y_2$ each represents N or CH provided at least one of $G_1$ and $Y_1$ is N and at least one of $G_2$ and $Y_2$ is N.

15. A silver halide photographic material according to claim 14, wherein $W_9$–$W_{12}$ each independently represent an aryloxy or arylamino, any of which may be substituted or unsubstituted.

16. A silver halide photographic material comprising a red sensitive silver halide emulsion layer wherein the silver halide emulsion is prepared in the presence of a hexacoordination complex of rhenium, ruthenium or osmium with at least four cyanide ligands and the silver halide content of the emulsion comprises at least about 90 mole percent silver chloride, wherein the emulsion contains a thiosulfonate and either a sulfinate or seleninate, and dye of formula (Ia) used in combination with a dye for formula (IIa):

(Ia)

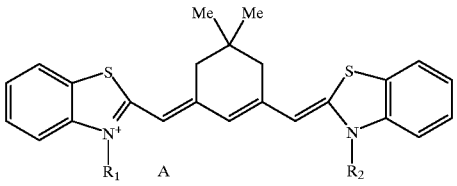

(IIa)

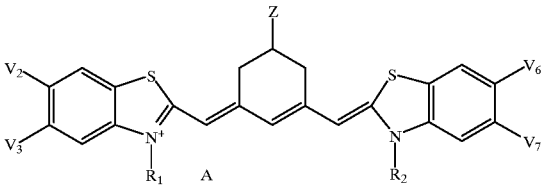

in which:

$R_1$ and $R_2$ each independently represent an alkyl group or a substituted alkyl group;

$V_2$–$V_7$ are independently H or a 1 to 8 carbon alkyl;

Z is a hydrogen or methyl;

A is a counterion if needed to balance the charge.

17. A photographic material according to claim 16, wherein the hexacoordination complex is of the formula:

$$[Q(CN)_{6-y}L_y]^{-n}$$

where:

Q is rhenium, ruthenium, or osmium,

L is a bridging ligand, y is 0, 1, or 2, and

−n is −2, −3, or −4.

18. A photographic material according to claim 16, wherein Q is ruthenium and y is 0.

19. A photographic material according to claim 16, wherein the emulsion contains a thiosulfonate of formula (IV)

$$T^1—SO_2—Y^1 \quad (IV)$$

and either a sulfinate compound of formula (Va):

$$T^2—SO_2—Y^2 \quad (Va)$$

or a seleninate compound of formula (Vb):

$$T^2—SeO_2—Y^2 \quad (Vb)$$

$Y^1$ and $Y^2$ are independently selected from the group consisting of a metal ion and

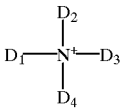

wherein $D_1$, $D_2$, $D_3$, and $D_4$ are independently selected from the group consisting of hydrogen and an alkyl of 1–3 carbon atoms, and $T^1$ and $T^2$ are independently selected from the group consisting of an unsubstituted or substituted alkyl of 1 to 22 carbon atoms, an alkenyl of 2 to 22 carbon atoms, an alkynyl of 2 to 22 carbon atoms, an unsubstituted or substituted aryl group having 6 to 20 carbon atoms, an unsubstituted or substituted 5 to 15-membered heterocyclic group having one or two heteroatoms and a divalent linking group.

20. A silver halide photographic material of claim 19, wherein the emulsion contains a thiosulfonate and a sulfinate.

21. A silver halide photographic material of claim 20, wherein the emulsion contains p-toluene thiosulfonate and p-toluene sulfinate.

22. A photographic material according to claim 16 wherein the emulsion further comprises a compound of formula (III):

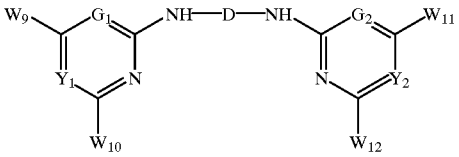

(III)

wherein:

D is a divalent aromatic moiety

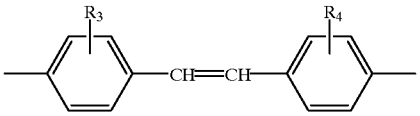

in which $R_3$ and $R_4$ are independently an acid or acid salt group, or an acid or acid salt substituted alkyl;

$W_9$–$W_{12}$ each independently represents a hydrogen atom, a halogen atom, an amino, alkylamino, arylamino, cycloalkylamino, heterocyclicamino, arylalkylamino, alkoxy, aryloxy, alkylthio, heterocyclicthio, mercapto, alkylthio, arylthio or aryl group, any of which may be substituted or unsubstituted, or a hydrogen or halogen atom;

$G_1$ and $G_2$ each represents N or CH;

$Y_1$ and $Y_2$ each represents N or CH provided at least one of $G_1$ and $Y_1$ is N and at least one of $G_2$ and $Y_2$ is N.

23. A silver halide photographic material according to claim 16 wherein the silver halide is substantially at least about 95 percent silver chloride.

24. A silver halide photographic material according to claim 16 additionally comprising a heterocyclic mercapto anti-foggant compound.

25. A method of adjusting the heat sensitivity of a red silver halide emulsion having a silver halide content of at least about 90 mole percent silver chloride, which method comprises preparing the emulsion in the presence of a hexacoordination complex of rhenium, ruthenium or osmium, the emulsion also comprising a thiosulfonate and either a sulfinate or seleninate, which method comprises and adding Dye A and Dye B to the emulsion, wherein Dye A of structure I or II:

(I)

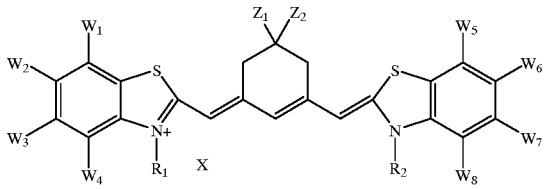

(II)

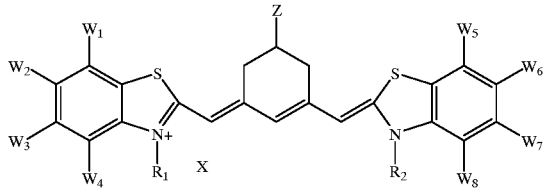

where, $R_1$ and $R_2$ each independently represents an alkyl group or a substituted alkyl group;

X is a counterion, if needed, to balance the charge of the dye;

Z is a hydrogen or halogen atom or an alkyl group or a substituted alkyl group;

$Z_1$ and $Z_2$ are each independently a 1–8 carbon alkyl group;

$W_1$–$W_8$ each independently represent a hydrogen atom, a halogen atom, an alkyl group, an acyl group, an acyloxy group, an alkoxycarbonyl group, a carbonyl group, a sulfamoyl group, carboxyl group, cyano group, hydroxy group, an amino group, an acylamino group, an alkoxy group, an alkylthio group, an alkylsulfonyl group, sulfonic acid group, aryl group, or aryloxy group, and $W_1$ and $W_2$; $W_2$ and $W_3$; $W_3$ and $W_4$; $W_5$ and $W_6$; $W_6$ and $W_7$; $W_7$ and $W_8$ can bond to each other via their carbon atoms to form a condensed ring; and wherein:

in structure I substituents $W_1$–$W_8$ are chosen such that J is $\geqq 0.0$, where J is defined as the sum of the Hammett $\sigma_p$ values of $W_1$–$W_8$, and in structure II substituents $W_1$–$W_8$ are chosen such that J is $\geqq 0.24$; and Dye B is of structure I or II:

(I)

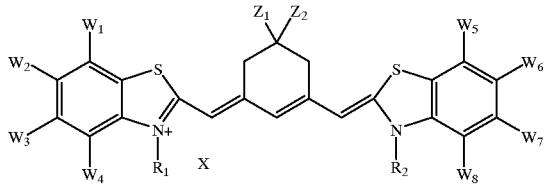

(II)

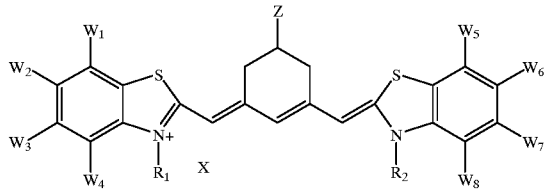

where, $R_1$ and $R_2$ each independently represent an alkyl group or a substituted alkyl group;

X is a counterion, if needed, to balance the charge of the dye;

Z is a hydrogen or halogen atom or an alkyl group or a substituted alkyl group;

$Z_1$ and $Z_2$ are each independently a 1–8 carbon alkyl group;

$W_1$–$W_8$ each independently represent a hydrogen atom, a halogen atom, an alkyl group, an acyl group, an acyloxy group, an alkoxycarbonyl group, a carbonyl group, a sulfamoyl group, carboxyl group, cyano group, hydroxy group, an amino group, an acylamino group, an alkoxy group, an alkylthio group, an alkylsulfonyl group, sulfonic acid group, aryl group, or aryloxy group, and $W_1$ and $W_2$; $W_2$ and $W_3$; $W_3$ and $W_4$; $W_5$ and $W_6$; $W_6$ and $W_7$; $W_7$ and $W_8$ can bond to each other via their carbon atoms to form a condensed ring; and wherein:

in structure I substituents $W_1$–$W_8$ are chosen such that J is $\leqq -0.14$ and in structure II substituents $W_1$–$W_8$ are chosen such that J is $\leqq 0.10$.

* * * * *

UNITED STATES PATENT AND TRADEMARK OFFICE

CERTIFICATE OF CORRECTION

PATENT NO. : 5,922,525
DATED : July 13, 1999
INVENTOR(S) : Richard P. Garnsey, et al It is certified that error appears in the above-identified patent and that said Letters Patent is hereby corrected as shown below:

Claim 19, Column 18, Line 10 -- "$T^1$-$SO_2$-$Y^1$" should read -- $T^1$-$SO_2S$-$Y^1$ --.

Signed and Sealed this

Eleventh Day of April, 2000

*Attest:*

*Attesting Officer*

Q. TODD DICKINSON

*Director of Patents and Trademarks*